US005090500A

United States Patent [19]

Yousef et al.

[11] Patent Number: 5,090,500

[45] Date of Patent: Feb. 25, 1992

[54] REPLACEABLE WEAR SLEEVE FOR PERCUSSION DRILL

[75] Inventors: Faisal J. Yousef; Robert F. Kane, both of Houston, Tex.

[73] Assignee: Sandvik Rock Tools, Inc., Bristol, Va.

[21] Appl. No.: 619,966

[22] Filed: Nov. 30, 1990

[51] Int. Cl.[5] ..... E21B 10/36; E21B 10/46; E21B 17/10

[52] U.S. Cl. ..... 175/320; 175/409; 175/414; 175/415

[58] Field of Search ..... 175/293, 320, 321, 409, 175/414, 415, 417–420; 173/78, 80, 132, 133; 166/242

[56] References Cited

U.S. PATENT DOCUMENTS

| | | | |
|---|---|---|---|
| 3,072,843 | 1/1963 | Clements et al. . | |
| 3,322,216 | 5/1967 | Kurt | 175/414 |
| 3,612,191 | 10/1971 | Martini | 175/320 |
| 3,991,834 | 11/1976 | Curington | 173/80 |
| 4,043,611 | 8/1977 | Wallace | 308/4 A |
| 4,350,348 | 9/1982 | Cox | 175/414 |
| 4,706,764 | 11/1987 | Hughes | 175/320 |
| 4,836,306 | 6/1989 | Barrows | 175/321 |

FOREIGN PATENT DOCUMENTS

| | | | |
|---|---|---|---|
| 1008403 | 3/1983 | U.S.S.R. | 175/414 |

*Primary Examiner*—Hoang C. Dang
*Attorney, Agent, or Firm*—Burns, Doane, Swecker & Mathis

[57] ABSTRACT

A percussion drill includes a reciprocating piston surrounded by a cylindrical casing. Disposed at opposite ends of the cylindrical casing are replaceable hollow cylindrical wear sleeves. The wear sleeves are mounted within recesses formed in the outer surface of the casing. Each wear sleeve has a thickness equal to the depth of its respective recess. A longitudinal inner end of each wear sleeve is spaced longitudinally from an end surface of the recess, and a flexible seal is situated between those opposing ends. The wear sleeves can be replaced after being worn by the abrasive environment encountered in the hole being drilled. The wear sleeves may be formed of a more wear resistant material than the casing.

16 Claims, 2 Drawing Sheets

FIG. 1
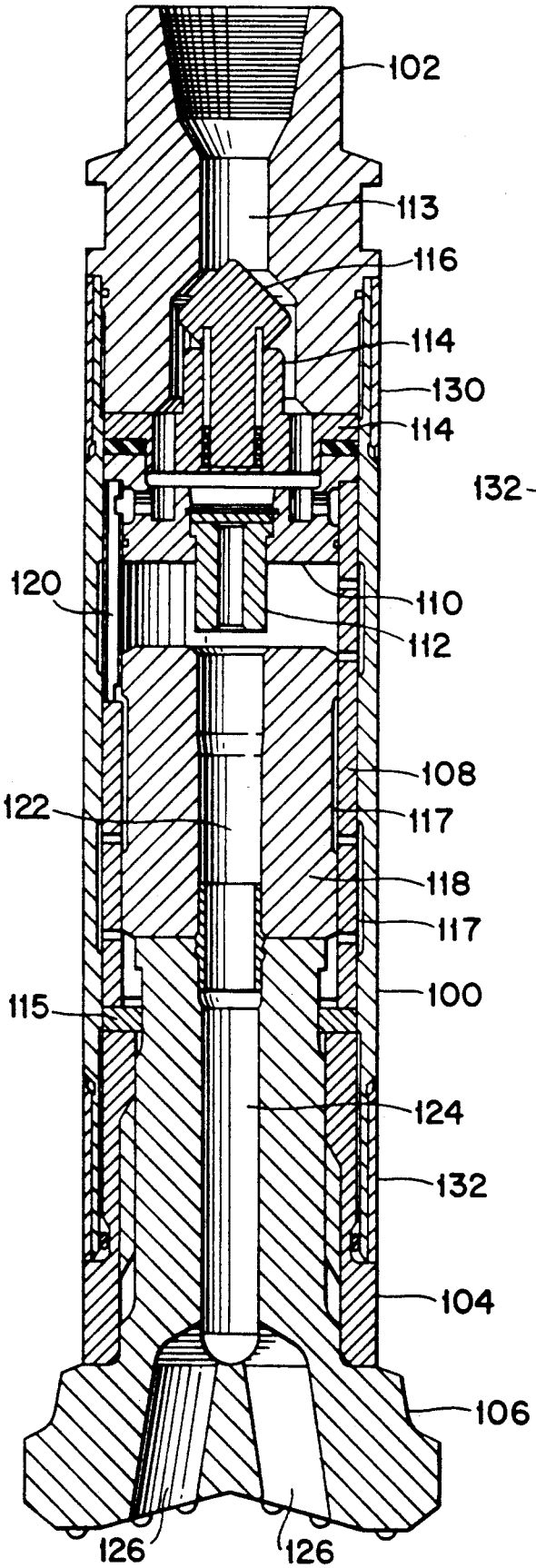
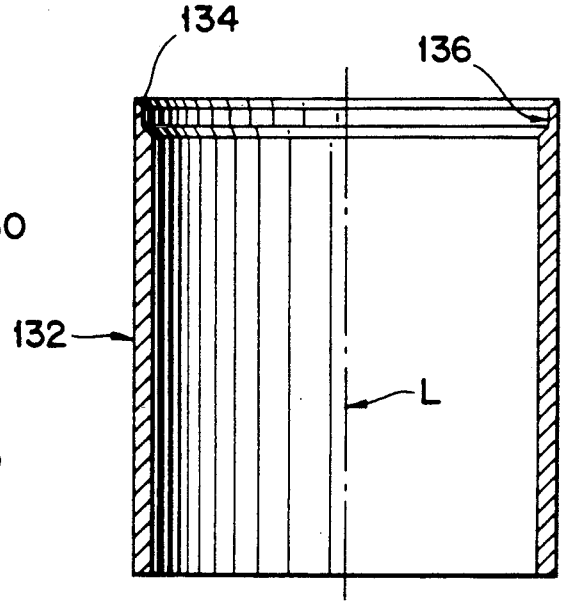
FIG. 2
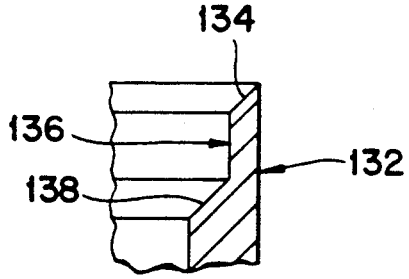
FIG. 3

REPLACEABLE WEAR SLEEVE FOR PERCUSSION DRILL

BACKGROUND OF THE INVENTION

The present invention relates to down-the-hole tools, especially percussion drilling equipment for drilling holes in earth and rock formations.

The drilling of holes in hard subterranean formations is often performed by percussion drilling equipment, such as so-called down-the-hole hammers wherein a reciprocating hammer piston situated in the drill string immediately above the drill bit imparts percussive blows to the drill bit to promote the cutting action. The hammer position reciprocates within a cylindrical piston case which is connected at its lower end to a driver sub and at its upper end to a rear sub.

The cuttings are removed from the hole by a fluid, such as air (or liquid), which is conducted downwardly through the drill string and then ejected from a front end of the drill bit to cool the latter and entrain cuttings. The air, together with cuttings entrained therein, is conducted upwardly through an annular space formed between the outer surface of the tool and the inside wall of the hole being drilled. As a result, the outer surface of the tool, especially that of the piston case, is subjected to severe abrasion and erosion due to contact with the abrasive cuttings.

Once the piston case has been excessively worn, it must be replaced, resulting in lost drilling time and the added cost of a replacement piston case. It has been observed that the areas of the piston case outer surface which undergo the most rapid wear (and which thus determine the frequency of the replacement procedure), are the areas located at the top and bottom ends of that outer surface.

It has previously been known that areas of well drilling tools which are susceptible to wear can be protected by applying a coating of hard material to the wearsusceptible area, e.g., see U.S. Pat. No. 4,043,611. However, efforts required to apply the coating are complicated and expensive.

It has also been proposed in U.S. Pat. No. 4,706,764 to provide a cylindrical wear collar around a lower end of the driver sub to cover a portion of the latter that extends beyond a lower end of the piston casing. That proposed wear collar may include an upward extension which covers a lower portion of the piston casing. In order to secure the collar in place, the driver sub includes an upwardly facing shoulder which abuts an opposing surface of the collar to push the collar against the bottom end of the piston casing. The bottom end of the collar serves as an upward abutment surface for the drill bit. Thus, during a drilling operation the drill bit impacts against that abutment surface of the collar. Those impacts serve to place the collar under longitudinal compression, since the upper end of the collar abuts the piston casing. Therefore, the collar would have to be made of sufficient size and bulk to withstand those impacts and compression. As a result, the outer diameter of the collar would be so large (e.g., larger than the outer diameter of the piston casing) that the width of the gap formed between the collar and the side of the hole being drilled would be reduced. Such a reduction would produce an increase in the velocity of the air and cuttings flowing through that gap, thereby intensifying the rate of abrasive wear of the collar.

It would be desirable to provide an apparatus which enables the wear-susceptible areas of a piston collar to be protected in a simple manner without appreciably reducing the width of the cutting gap and without requiring the use of a large, bulky (and thus expensive) wear member.

SUMMARY OF THE INVENTION

The present invention involves a casing assembly for a tool which is adapted to be disposed in a subterranean hole containing an abrasive environment. The casing assembly is adapted to shield a component of the tool from that abrasive environment. The casing assembly comprises a cylindrical casing defining a longitudinal axis and having a longitudinal first end. The casing includes a first annular recess which extends longitudinally inwardly from the first end and which terminates at a distance therefrom whereby a longitudinal inner end of the first recess is defined by a first generally radial shoulder which faces longitudinally outwardly. A replaceable hollow cylindrical wear sleeve is disposed within the first recess so as to be coaxial with the casing. The wear sleeve includes a longitudinal inner end which faces the longitudinal inner end of the first annular recess and is spaced longitudinally therefrom. The wear sleeve includes a second annular recess situated adjacent the longitudinal inner end of the wear sleeve and forming a second generally radial shoulder which faces the first generally radial shoulder. A flexible seal is disposed between the first and second generally radial shoulders for excluding abrasives.

Preferably, the wear sleeve is formed of a more wear resistant material than the casing.

It is also preferable that the radial thickness of the wear sleeve be no greater than a radial depth of the first recess. Most preferably, those radial thicknesses are equal, whereby the longitudinal surface of the wear sleeve is contiguous with the longitudinal surface of the casing. It is also preferable that wear sleeves are disposed on opposite ends of the casing.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a longitudinal sectional view of a percussion drill which contains wear sleeves according to the invention;

FIG. 2 is a longitudinal sectional view through a wear sleeve according to the present invention;

FIG. 3 is an enlarged fragmentary view of a longitudinal section through the wear sleeve.

DETAILED DESCRIPTION OF A PREFERRED EMBODIMENT OF THE INVENTION

Figure 4:
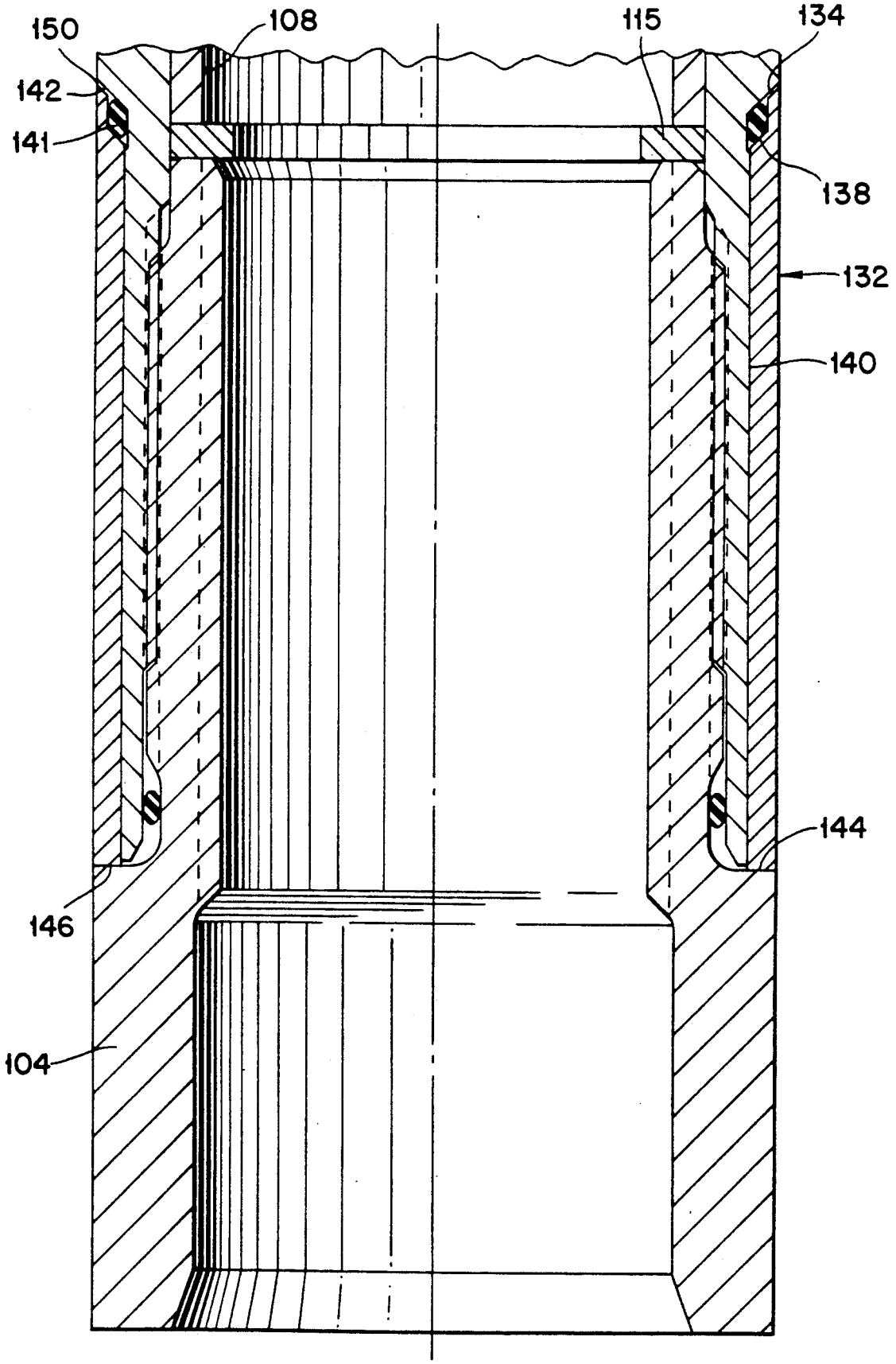
FIG. 4 is a longitudinal sectional view through a lower portion of a percussion tool, depicting a lowermost wear sleeve

A percussion drill depicted in FIG. 1 comprises a hollow cylindrical piston casing 100, a rear sub 102 threadedly attached to a rear or upper end of the casing 100, and a front or driver sub 104 threadedly attached to a front or lower end of the casing 100. A drill bit 106 is mounted in the front sub 104 and is connected for common rotation therewith by longitudinal splines. Disposed within the casing 100 is an inner cylindrical sleeve 108, a front end of which rests upon a split retaining ring 115, the latter lying on the front sub 104. Seated on a rear end of the inner sleeve is a support body 110 which carries a forwardly extending tube 112. Sandwiched between the support body and the rear sub 102 is a valve guide member 114 in which a check valve 116 is spring-biased toward a closed position. Slidably mounted within the inner sleeve is a hammer piston 118.

Pressurized fluid is conducted downwardly within a central passage 113 formed within the rear sub 102, through the valve guide member and the support body, then through holes 120 formed in the inner sleeve 108, and then into a channel arrangement 117 defined by opposing surfaces of the inner sleeve, the hammer piston, and the casing. The pressurized fluid, preferably a gas such as air, is conducted through the channel arrangement is directed alternately to front and rear ends of the hammer piston for reciprocating the piston forwardly and rearwardly in a manner which is well known in the art. During its forward stroke, the piston strikes the drill bit to promote the cutting action. The arrangement of the air-conducting passages may vary and forms no part of the present invention.

Some of the pressurized air is diverted through central passages 122, 124 in the piston 118 and drill bit and is discharged forwardly through diverging discharge passages 126 located at the front end of the drill bit. That discharged air entrains cuttings produced by the drill bit and, together with the entrained cuttings, travels upwardly within a annular space or gap formed between the outer periphery of the tool and the wall of the hole being drilled. The traveling cuttings abrasively contact the outer surface of the casing 100, resulting in an accelerated wearing thereof, especially at upper and lower ends of the casing.

In accordance with the present invention, removable wear sleeves 130, 132 are disposed around the upper and lower ends of the casing. Those wear sleeves are preferably formed of a more wear resistant material than the casing, such as heat treated steel for example.

The wear sleeves 130, 132 are preferably of identical construction, and thus only the lower wear sleeve 132 will be described hereafter in detail (see FIGS. 2–4). The rear or upper end 134 of that sleeve 132 is beveled so as to form a generally radial shoulder. Preferably, the shoulder 134 faces generally rearwardly and generally toward a longitudinal axis L of the sleeve. A recess 136 is formed immediately longitudinally or axially inwardly of the end 134, which recess terminates at a generally radial shoulder 138. The latter is also beveled so as to face generally rearwardly and generally toward the longitudinal axis of the sleeve.

The sleeve 132 is inserted in telescoping fashion over a reduced diameter portion 140 of the lower end of the casing 100 such that the shoulder 134 of the sleeve faces toward an opposing generally radial shoulder 142 of the casing 100. Positioned within the recess 136 are a pair of elastic O-rings 141 (see FIG. 4) which are compressed between the shoulder 138 of the sleeve and the opposing shoulder 142 of the case. That compression of the O-rings occurs when the driver sub 104 is attached to the casing 100, i.e., when an upwardly facing shoulder 144 of the driver sub pushes against a lower end 146 of the sleeve 132.

By compressing the O-rings 141 between the shoulders 138 and 142, a seal is created between the sleeve 132 and the casing 100 to block the migration of cuttings which may have passed through the space 150 formed between the shoulder 142 of the casing 100 and the upper end 134 of the sleeve.

As noted earlier, the upper or rear wear sleeve 130 is preferably of identical configuration as the front or lower rear sleeve 130. Attention is directed to the fact that the uppermost or rearmost end of the rear wear sleeve is considered to constitute the longitudinal outer end of that wear sleeve. That is, each of the wear sleeves extends longitudinally inwardly from a longitudinally outer end of the casing toward the midpoint of the casing.

It will be appreciated that the presence of the space 150 and the elasticity of the seals 141 permits a limited amount of relative longitudinal movement between the sleeve 132 and the casing 100. Consequently, the sleeve will not be excessively compressed longitudinally when upward forces from the drill bit are transmitted to the sleeve through the driver sub 104. That means that the sleeve need not be sized to withstand high compressive loading, but rather can be of relatively small thickness. The expense and handling difficulty of the sleeve are thus minimized.

Furthermore, the presence of the space 150 does not result in a longitudinally rattling of the collar or in the build-up of cuttings between the casing and sleeve, because the seals 141 will elastically constrain the sleeve as well as obstruct migration of the cuttings.

In sum, it will be appreciated that the sleeves 130, 132 resist wear at highly wear-susceptible areas of the casing. Therefore, the life of the casing is increased, thus the frequency with which the tool must be raised from the hole to perform maintenance on the casing is reduced. Furthermore, when the wear sleeves do become worn, it is merely necessary to replace the wear sleeves rather than the more expensive casing.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A casing assembly for a tool adapted to be disposed in a subterranean hole containing an abrasive environment, said casing assembly adapted to shield a component of the tool from such abrasive environment and comprising:

a cylindrical casing defining a longitudinal axis and having an axial first end, said casing including a first annular recess extending axially inwardly from said first end and terminating at a distance therefrom whereby an axial inner end of said first recess is defined by a first generally radial shoulder facing axially outwardly, a replaceable hollow cylindrical wear sleeve disposed within said first recess so as to be coaxial with said casing, said wear sleeve including an axial inner end facing and spaced axially from said axial inner end of said first annular recess, said wear sleeve including a second annular recess situated adjacent said axial inner end of said wear sleeve and forming a second generally radial shoulder facing said first generally radial shoulder, and flexible seal means disposed between said first and second generally radial shoulders for excluding abrasives.

2. A casing assembly according to claim 1, wherein said wear sleeve is formed of a more wear-resistant material than said casing.

3. A casing assembly according to claim 1, wherein said first recess is formed in an outer circumferential surface of said casing, and said second recess is formed in an inner circumferential surface of said casing.

4. A casing assembly according to claim 3, wherein a radial thickness of said wear sleeve is no greater than a radial depth of said first recess.

5. A casing assembly according to claim 4, wherein said radial thickness equals said radial depth.

6. A casing assembly according to claim 4, wherein said wear sleeve is formed of a more wear-resistant material than said casing.

7. A casing assembly according to claim 1, wherein said first and second generally radial shoulders are of frusto-conical configuration.

8. A casing assembly according to claim 1, wherein said second end of said casing includes a third annular recess extending axially inwardly from said second end and terminating short of said first recess, a second replaceable hollow cylindrical wear sleeve disposed within said third recess so as to be coaxial with said casing, said second wear sleeve including a fourth recess at an end thereof remote from said second end of said casing, said third and fourth recesses together forming a second annular chamber, and second elastic seal means disposed in said second chamber between axially opposing shoulders of said casing and said second wear sleeve, respectively, for excluding abrasives.

9. A drilling tool for drilling holes in subterranean formations, comprising a drill bit mounted within an axial front end of a bit carrier, said bit carrier including a cylindrical casing, a front sub threadedly received within said casing, and a rear sub threadedly received within a rear axial end of said casing, said rear sub adapted to be connected to a tool carrier, the improvement wherein:

said cylindrical casing includes a first axial end, a first annular recess being formed in an outer circumferential surface of said casing and extending axially inwardly from said first end, said first annular recess terminating at a distance from said first axial end to define an axial inner end of said first recess which includes a first generally radial shoulder facing axially outwardly, a replaceable hollow cylindrical wear sleeve being disposed within said first recess so as to be coaxial with said casing, said wear sleeve including an axial inner end facing and spaced axially from said axial inner end of said first annular recess, an inner circumferential surface of said wear sleeve including a second annular recess situated adjacent said axial inner end of said wear sleeve and forming a second generally radial shoulder facing said first radial shoulder, seal means disposed between said first and second generally radial shoulders, said wear sleeve including an axial outer end engaged by one of said front and rear subs which pushes said second generally radial shoulder toward said first generally radial shoulder to compress said seal means.

10. A drilling tool according to claim 9, wherein said wear sleeve is formed of a more wear-resistant material than said casing.

11. A drilling tool according to claim 9, wherein a radial thickness of said wear sleeve is no greater than a radial depth of said first recess.

12. A drilling tool according to claim 11, wherein said radial thickness equals said radial depth.

13. A drilling tool according to claim 11, wherein said wear sleeve is formed of a more wear-resistant material than said casing.

14. A drilling tool according to claim 9, wherein said first and second generally radial shoulders are of frusto-conical configuration.

15. A drilling tool according to claim 9, wherein said second end of said casing includes a third annular recess extending axially inwardly from said second end and terminating short of said first recess, a second replaceable hollow cylindrical wear sleeve disposed within said third recess so as to be coaxial with said casing, said second wear sleeve including a fourth recess at an end thereof remote from said second end of said casing, said third and fourth recesses together forming a second annular chamber, and second elastic seal means disposed in said second chamber between axially opposing shoulders of said casing and said second wear sleeve, respectively, for excluding abrasives.

16. A drilling tool according to claim 9 including a piston mounted for reciprocal movement within said casing, said piston arranged to impart downward impact to said drill bit.

* * * * *